US005139535A

United States Patent [19]

Strickland et al.

[11] Patent Number: 5,139,535

[45] Date of Patent: Aug. 18, 1992

[54] TWO-STAGE FIXED-BED GASIFIER WITH SELECTABLE MIDDLE GAS OFF-TAKE POINT

[75] Inventors: Larry D. Strickland; Larry A. Bissett, both of Morgantown, W. Va.

[73] Assignee: The United States of America as represented by the United States Department of Energy, Washington, D.C.

[21] Appl. No.: 697,033

[22] Filed: May 8, 1991

[51] Int. Cl.[5] ..... C01J 3/22; C01J 3/82

[52] U.S. Cl. ..... 48/76; 48/77; 48/85.1

[58] Field of Search ..... 48/76, 77, 63, 64, 66, 48/85, 68, 85.1, 67, 69; 266/197

[56] References Cited

U.S. PATENT DOCUMENTS

| | | | |
|---|---|---|---|
| 3,454,382 | 7/1969 | Hamilton | 48/76 |
| 4,340,463 | 7/1982 | Harak . | |
| 4,344,772 | 8/1982 | Pillard | 48/77 |
| 4,456,455 | 6/1984 | Shvebotham | 48/76 |
| 4,517,165 | 5/1985 | Moriarty . | |
| 4,578,175 | 3/1986 | Gorin . | |
| 4,725,350 | 2/1988 | Smith . | |
| 4,758,331 | 7/1988 | Kruse et al. . | |
| 4,842,719 | 1/1989 | MacArthur et al. . | |

OTHER PUBLICATIONS

Handbook of Gasifiers and Gas Treatment Systems, Raj D. Parekh, WD-TR-82/008-010 Sep. 1988, pp. 2A.2-4-2A.41.

*Primary Examiner*—Peter Kratz

*Attorney, Agent, or Firm*—David E. Breeden; Stephen D. Hamel; William R. Moser

[57] ABSTRACT

A two-stage fixed bed coal gasifier wherein an annular region is in registry with a gasification zone underlying a devolatilization zone for extracting a side stream of high temperature substantially tar-free gas from the gasifier. A vertically displaceable skirt means is positioned within the gasifier to define the lower portion of the annular region so that vertical displacement of the skirt means positions the inlet into the annular region in a selected location within or in close proximity to the gasification zone for providing a positive control over the composition of the side stream gas.

12 Claims, 2 Drawing Sheets

TWO-STAGE FIXED-BED GASIFIER WITH SELECTABLE MIDDLE GAS OFF-TAKE POINT

The United States Government has rights in this invention pursuant to the employer-employee relationship of the U.S. Department of Energy and the inventors.

BACKGROUND OF THE INVENTION

The present invention relates generally to a two-stage, fixed-bed coal gasifier having dual gas off-takes for providing a middle or side stream of relatively tar-free, high temperature gas, and more particularly to such a gasifier wherein movable skirt means are incorporated within the gasifier for selectively positioning the off-take point for the middle gas stream.

Two-stage, fixed-bed gasifiers having dual off-takes for the gases produced during the gasification of coal are well known. An upper stage of the two stages of gasification defines a coal distillation and devolatization zone while a lower stage defines a combustion or gasification zone. A portion of the gaseous products produced in the gasification zone is commonly referred to as a side stream or middle stream and is removed before any contact with the fresh coal so as to be relatively clean and tar free. This middle stream of gas is normally at a temperature of about 1000°-1600° F. Another portion of the hot gases produced in the gasification zone is referred to as the top gas and is directed upwardly through the devolatization zone where it is utilized to gradually increase the temperature of the incoming coal to a level sufficient to liberate and entrain tar and other volatile matter from the coal prior to the discharge thereof through a top gas off-take in the gasifier. This top gas stream exiting the devolatization zone is usually at a temperature in the range of about 250° to about 800°

While the success of the fixed-bed, two-stage dual off-take gasifiers has been satisfactory, there are some problems or shortcomings which detract from these gasifiers in their present form. For example the composition and to some extent the temperature of the middle stream of gas is highly dependent upon the point of withdrawal of this middle stream from the gasification zone. The fixed-bed gasifiers as presently known provide the gasifier with a fixed vertically extending annulus having an opening near the gasification zone for splitting the gas prior to or after the exit thereof from the gasification zone into the middle gas stream and the top gas stream for the purpose of providing the middle gas stream with a desired composition. A withdrawal of the middle gas stream from a point near the top of the gasification zone would normally provide for a middle stream of gas with less tar content than would be attainable by withdrawing the middle stream from a point above the gasification zone. However, the composition and temperature of the middle gas stream taken off at a given point in or near the gasification zone is largely dependant upon variables in the process parameters and the reactivity of the coal utilized. For example, coals useable in fixed-bed gasifiers can have significantly different compositions and heating values. Also, the use of differing steam to air ratios and/or different gasifier operating pressures ranging from about atmospheric to about 2000 psig have a considerable effect upon the composition and the temperature of the gases at any given vertical position within a two-stage gasifier.

Thus, by merely changing the coal heating values or any of the various operating parameters, any optimization of the composition of the middle gas stream in a gasifier with an annulus in a fixed vertical position becomes very difficult to achieve. Some control over the composition of the middle gas stream may be achieved to some degree of satisfaction by using complex controls over the process parameters for controlling the gasification reactions. One such effort used in the prior art relates to controlling the volume of the gas passing through the devolatization zone to regulate the cracking and other reactions occurring in the devolatization zone and is provided by employing a valve in the middle gas outlet line so as to control the volume of middle gas flowing upwardly through the devolatization zone. While such a valve arrangement does provide for some control over the volume of gases exiting from the gasifier through the middle gas stream off-take, this arrangement can not adequately control the composition of the middle gas stream especially when using coals of different reactivities and different steam to air ratios.

SUMMARY OF THE INVENTION

Accordingly, a primary objective of the present invention is to provide an improved two-stage fixed-bed gasifier by modifying a fixed annulus in the interior of the gasifier that encompasses the devolatilization zone and used to split the gas streams to incorporate a position-adjustable means which can be vertically extended to any suitable location within or near to the gasification zone to selectively position the off-take point utilized for the separation and withdrawal of the middle gas stream. By such selective positioning of the off-take point for the middle gas stream, the composition of the middle gas can be readily selected and maintained at the selected values essentially independent of variances in coal reactivities and process parameters. Generally, the present invention is directed to a fixed-bed gasification means comprising an enclosed gasifier having a volume therein defining a coal gasification zone and a coal devolatilization zone overlying the gasification zone. The gasifier comprises a vertically oriented housing means having a first wall section which is substantially disposed about the zones and a second wall section which is connected to the first wall section at the top end thereof. The second wall section includes a fixed elongated annular portion which vertically extends into first wall section and substantially encompasses the devolatilization zone. This annular portion is positioned in the first wall section at a location inwardly spaced therefrom for defining therebetween a vertically extending annular volume that is separated from the devolatilization zone by the annular portion and has an opening thereinto at a lowermost end thereof. Inlet means are in the second wall section for introducing coal into the devolatilization zone encompassed by the annular wall portion. First gas off-take means are in registry with the second wall section at a location overlying the devolatilization zone for conveying from the gasifier gaseous products passing upwardly through the devolatilization zone and the annular portion. Second gas off-take means are in registry with the annular volume for conveying from a selected point of withdrawal in the gasifier as defined by the opening into the annular volume gasification products substantially comprising gaseous products generated in the gasification zone. Vertically movable wall means are operatively associated with the annular portion and are adapted to be vertically positionable within the gasifier for selectively positioning the aforementioned point of withdrawal to control at least the composition of the gaseous products discharged from the gasifier through the second off-take means.

Another object of the present invention is to provide for the cooling of the vertically movable wall means as defined by a sleeve or skirt so that the wall means can be appropriately positioned within the high temperature gasification zone as needed for controlling the composition of the middle gas stream.

Still another object of the present invention is to provide the skirt with a mechanism by which the middle gas stream off-take may be plugged so that the gasifier can be converted from a two-stage gasifier to a single stage gasifier.

Other and further objects of the present invention will become obvious upon an understanding of the illustrative embodiments about to be described or will be indicated in the appended claims, and various advantages not referred to herein will occur to one skilled in the art upon employment of the invention in practice.

Figure 1:
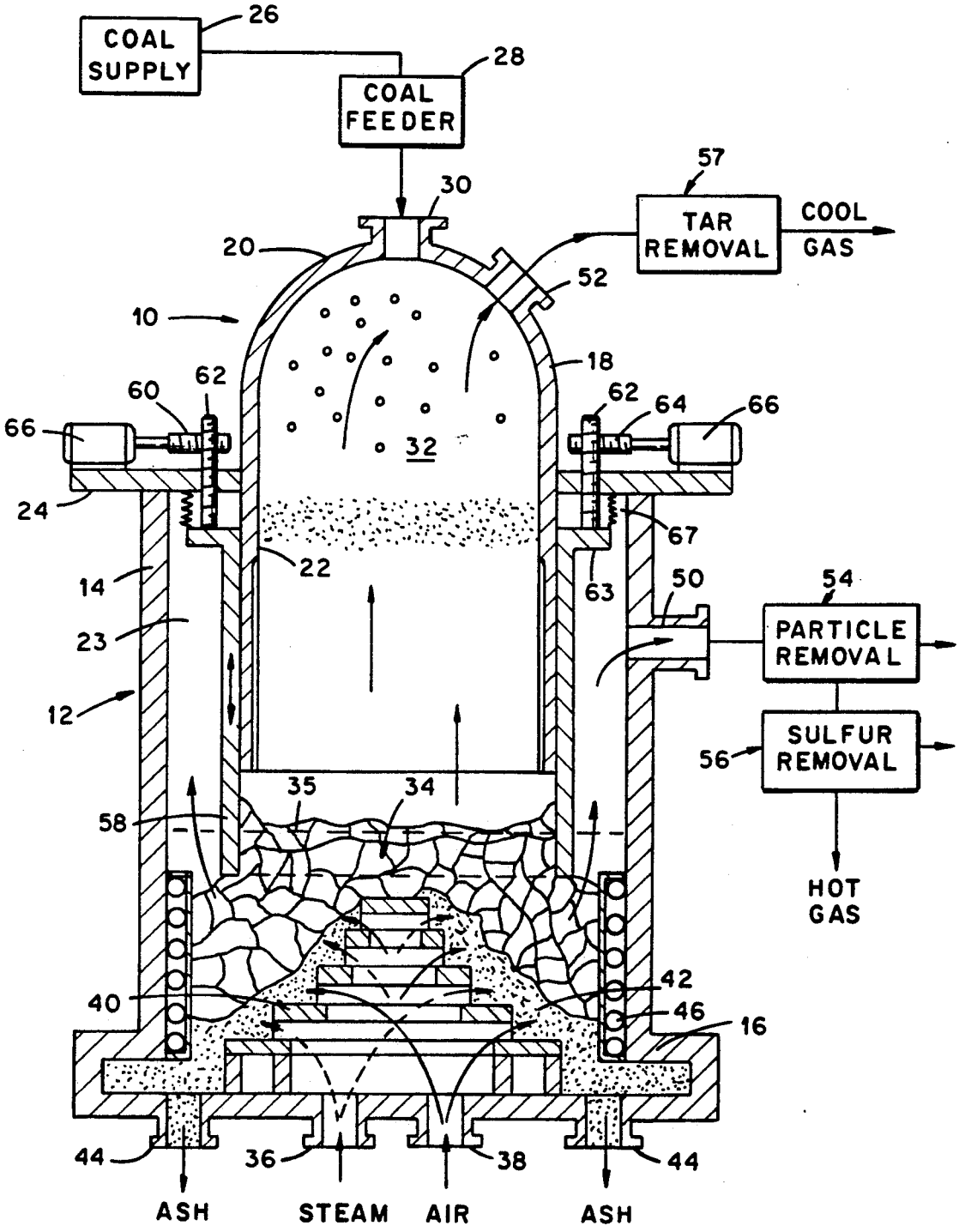
FIG. 1 is a elevation sectional view showing a schematic representation of a two-stage fixed bed gasifier incorporating the selectively positionable skirt or sleeve mechanism of the present invention.

Preferred embodiments of the invention have been chosen for the purpose of illustration and description. The preferred embodiments illustrated are not intended to be exhaustive nor to limit the invention to the precise forms shown. The preferred embodiments are chosen and described in order to best explain the principles of the invention and their application and practical use to thereby enable others skilled in the art to best utilize the invention in various embodiments and modifications as are best adapted to the particular use contemplated.

DETAILED DESCRIPTION OF THE INVENTION

As illustrated in the drawings the two-stage fixed-bed coal gasifier having dual gas off-takes is generally shown at 10 and comprises an enclosed housing 12 of a vertically oriented circular configuration. The housing 12 is provided by an elongated cylindrical shell or wall section 14 which extends from the base 16 of the gasifier to a location near the top of the gasifier and essentially encircles the volume within the gasifier wherein the coal gasification reactions occur as will be described below. An upper wall section 18 of a cylindrical or barrel shaped configuration having a domed top 20, as shown, is disposed within the shell 14. The upper wall section 18 includes a fixed vertically extending annular wall segment 22 which extends downwardly into the shell 14 at a location radially inwardly spaced therefrom so as to define an annular volume 23 between the inner walls of the shell 14 and the outer walls of the annular wall segment 22. This annular wall segment 22 terminates at a location substantially intermediate the base 14 of the gasifier and the top end wall 20 thereof, as will be described in greater detail below. The shell 14 and the upper wall section 18 are shown joined together at the top of the shell 14 by a suitable horizontal flange arrangement as generally shown at 24. This coupling between the shell 14 and the upper wall section may be achieved in any suitable manner such as by the use of a suitable bolting arrangement, not shown, which will permit the disassembly of the gasifier 10 for maintenance purposes or for addition or removal of extensions to the annular wall segment 22, as will be described below.

The gasifier 10 is coupled to a coal supply generally shown at 26. The coal utilized in the present invention may be of any suitable size in the range of about 2×0 inch, i.e., of a size 2 inches and under, and is fed into the gasifier 10 through a suitable coal feeder as generally shown at 28. This coal feeder 28 may be of any conventional type such as a lock-hopper which can be utilized for batch-type feeding of coal into the gasifier or a screw-type feeder which can provide for the continuous feeding of coal. The coal from the feeder 28 is fed into the gasifier through an inlet line 30 located at the top of the gasifier 10. A devolatization zone 32 for the coal introduced into the gasifier 10 is located generally within the upper wall section 18 and the annular segment. The coal is devolatilized as it descends through a devolatization zone and enters a gasification zone 34 encompassed by the shell 14 and generally underlying the devolatization zone 32. The devolatization zone 32 and the gasification zone 34 are not separated at a fixed location in the gasifier since varying process parameters and/or using coal of different reactivity will effect the relative size of these zones. However, for the purpose of this description a dotted line 35 is shown in FIG. 1 as a general location where the devolatization zone 32 and the gasification zone 34 separate from one another. Also, if desired, the devolatilization zone 32 may be stirred by any suitable mechanism to inhibit bed plugging when agglomerating coals are used. Steam and air for the gasification of the coal are respectively introduced into the gasifier 10 through inlets 36 and 38 at the base of the gasifier. A grate 40 is utilized to uniformly mix and distribute the air and steam and pass the resulting mixture into the lower end of the gasification zone 34. The gasifier 10 may be provided with a rotatable grate to facilitate the distribution of air-stream mixture as well as for the removal of ash 42 produced by the gasification reaction. This ash is discharged through outlets 44.

Once the gasification reaction is initiated in the gasifier by employing any suitable start-up technique, the steam and air pass through the hot ash 42 on the grate 40 and into the gasification zone 34 to effect an exothermic oxidation reaction with the devolatilized coal for providing gaseous combustion products which are primarily formed of carbon monoxide and carbon dioxide. The heat from this oxidation reaction is utilized in the devolatization zone 32 for the devolatization reaction so that the coal undergoing the gasification reaction will be essentially depleted of tars, oils, and other volatiles which would otherwise form part of the gaseous reaction products produced in the gasification zone. A water jacket 46 is preferably placed in the shell 14 about the gasification zone 34 so that water can be circulated through the jacket 46 to cool the walls of the gasifier and thereby assuring the integrity of the gasifier. Also, the heat can be extracted from this water and utilized for any suitable purpose.

As with conventional two-stage fixed-bed gasifiers, a portion of the gases produced in the gasification zone 34 commonly referred to as the side gas stream or the middle gas stream is directed into the annular space or volume 23 between the shell 14 and the annular wall segment 22 and directed to an outlet 50 near the top of the annular volume 23. The remaining portion of the gas produced in the gasification zone 34 is directed upwardly and countercurrently to the flow of the coal descending through the devolatization zone 32 to heat the coal sufficiently to volatilize tars and other volatiles in the coal. These gaseous volatiles are then entrained in this upwardly flowing gas stream and removed from the gasifier through an outlet 52 at the top end 20 of the devolatization zone 32. This gas is known as the top gas and depending on the coal and the operating conditions is usually at a temperature between about 250° and 800° F.

The middle stream of gas directed into the annular space 23 is at a temperature of about 1000° to 1600° F. when removed from the upper end of the annular space 23 through outlet 50. In as much as most of the tars and other volatiles are removed or stripped from the coal prior to the gasification thereof, the gases forming the middle gas stream are essentially tar-free and of high quality except for the presence of some sulfur species and particulate material. Typically, the middle gas stream is conveyed through a suitable solid particulate separator such as a cyclone generally shown at 54 and then into a suitable sulfur removing system as generally shown at 56 such as a bed of particulate adsorbent such as zinc ferrite iron oxide, or any other suitable sorbent which can be utilized to remove essentially all of the sulfur species from the gas stream without significantly decreasing the temperatures thereof. After cleaning the gas stream of particulates and sulfur species, the gas is still at a very high temperature so that the sensitive heat in this gas may be utilized in a heat extraction device such as a gas turbine.

The top gas containing the entrained tars, oils, and other volatiles in gaseous form is discharged from the gasifier 10 at temperatures at about 250°-800° F. and may be suitably cleansed of the entrained contaminates by passing the gas through a tar/particulate removal mechanism as generally shown at 57 which may include a tar cyclone for removing entrained coal particles and droplets of tar. Additionally, the tar removal mechanism 57 may include the cooling of the gas by water in a mixed gas cooler where tar, oil, and water vapors are condensed and removed from the gas stream. Any oil mist or other volatiles mists remaining in the gas may be removed in a suitable precipitation apparatus. The collected tars, oils, and other condensibles contain considerable heat values which can be utilized for combustion purposes. Alternatively, the gas can be cleansed of paticulates and maintained at temperatures sufficient to avoid tar condensation while being routed to a suitable heat extraction device such as a turbine.

In accordance with the improvement of the present invention as briefly described above, the composition of the middle gas can be selectively controlled in a two-stage or dual take-off gasifier essentially independent of the use of coal of different reactivities, the employment of different steam to air ratios, different operating pressures, and other process parameters which historically affected the gas composition and temperature of the middle gas when removed from the gasification zone at a fixed position as in conventional two-stage gasifiers. The present invention provides this selective control feature by deploying a vertically displaceable annular wall means defined by a skirt or sleeve as generally shown at 58 in the gasifier. As shown, the skirt 58 is supported about and vertically displaceable with respect to the fixed annular wall segment 22 in a direction either towards or away from the gasification zone 34 so as to selectively position the off-take point for the middle gas in the gasification zone. Thus, by selectively positioning this off-take point, the composition of the middle off-take gas can be controlled in a manner more efficiently and effectively than heretofore attainable. The skirt 58 as shown in the drawings, is preferably in the configuration of a right circular cylinder and encompasses the annular wall segment 22 in close proximity thereto to substantially inhibit the passage of gases between the outer surface of annular wall segment 22 and the inner surface of the skirt 58. Suitable seals, not shown, may be disposed at this interface between the annular wall segment 22 and the inner surface of the skirt to inhibit the passage of excessive gas flow through this interface. Since the skirt 58 is internally located in the gasifier, some gas leakage at the interface between the skirt 58 and the wall segment 22 can be tolerated without causing undue contamination of the middle gas especially since most of the devolatization of the coal would occur above the lower end of the annular wall segment 22.

The skirt 58 may be cooled or formed of any suitable material exhibiting satisfactory structural integrity at the high temperatures which may be encountered in the gasification zone. For example, the skirt could be formed of a suitable ceramic or refractory material such as conventionally employed in the construction of high temperature furnaces. The skirt 58 may be reciprocatively displaced in the gasifier 10 to position the lower horizontal end of the skirt 58 in a selected vertical position within the gasification zone 34 by any suitable means such as a screw and pinion-type arrangement as generally shown as 60 and which may comprise a threaded hanging bolt 62 which is attached at one end thereof to a shoulder 63 on the skirt 58 and which extends through the flange 24 of the gasifier 10 to be contacted by and driven by gear 64 coupled to a suitable drive such as a hydraulic, pneumatic, or electric motor as generally shown at 66. Seals such as metal bellows as shown at 67 may be positioned between the shoulder 63 and the flange 24 to inhibit the passage of gases from the gasifier through bores in the flange 24 containing the threaded hanging bolt 62. Of course, it will appear clear to those versed in the art that, depending upon the pressure at which the gasifier is operating, which may be in the range from atmospheric to about 2000 psig, any suitable sealing arrangement may be utilized around the mechanism used to displace the skirt mechanism which is capable of inhibiting the undesirable escape of gases from the gasifier.

The total vertical adjustment of the skirt 58 by the threaded bolt arrangement or any other suitable skirt positioning arrangement may be somewhat limited in some gasifiers having gasification zones of relatively large vertical displacements especially when extensive movement of the skirt 58 is required to compensate for the use of a particular type of coal while maintaining the middle gas at desired composition. In such instances, or in event that greater flexibility is desired for this vertical adjustment, the skirt 58 may be made up of or be provided with a plurality of annular segments, as generally shown at 68 in FIG. 2, which can be added or removed one or more at a time to provide a skirt 58 of sufficient length for effecting any desired displacement into the gasification zone. While only one such skirt extension 68 is shown, it will appear clear that this single extension may be formed of several smaller sections of the same size or of different sizes to form the skirt 58. The coupling between these skirt extensions may be achieved by any suitable manner such as by using offsetting flanged end portions which are engageable with one another to provide the connection. These flanged ends can be bolted or otherwise secured to one another in a separatable manner.

In as much as the skirt 58 may undergo considerable heating due to its positioning in the gasification zone 34, it may be desirable to cool the skirt 58 and any segments 68 defining the skirt 58. To provide such cooling, an annular vertically extending coolant channel 74 is placed in skirt 58. Any skirt extensions 68 added to this skirt 58 may be provided with an annular coolant channel 76 which is coupled to the channel 74 in the skirt 58 by a conduit or passageway 78. A removable plug such as a threaded plug, as generally shown at 82, may be utilized to plug the passageway 78 in the event the skirt extension is not utilized. If more than one skirt extension is utilized, the additional skirt extension may be provided with coolant channels and plugable passageways leading to the coolant channels. A conduit 84 is shown extending through the flange 24 of the gasifier and is coupled to the coolant channel 74 for conveying coolant into one or more coolant channels as provided by the skirt and any skirt extensions attached thereto. A similar conduit, not shown, is preferably used for conveying the heated water from the coolant channels. The heat in the water utilized to cool the skirt and skirt extensions may be extracted in any suitable manner for subsequent use.

Figure 2:
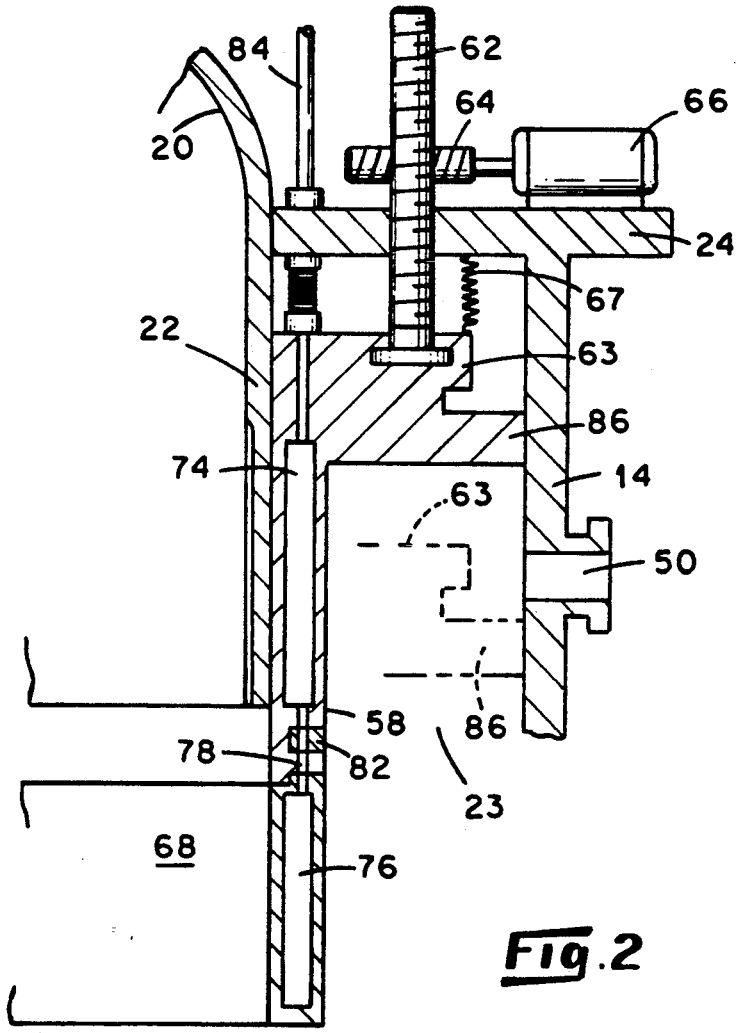
FIG. 2 is a fragmentary elevational view showing further details of an embodiment as in FIG. 1 as well as the use of a segmented skirt with water cooling and a selectively positionable plug carried by the skirt portion for converting the two-stage gasifier to a single-stage gasifier.

Another feature of the present invention is that the two-stage gasifier as described above may be readily modified to function as a single-stage gasifier if such an operation is desired. In accordance with this embodiment of the present invention, a plug 86 as shown in FIG. 2 may be attached to the skirt 58 at the uppermost end thereof with this plug projecting radially outwardly therefrom to a location closely adjacent to the inner wall of the shell 14. This plug 86 which may encircle the skirt 58 or any portion thereof has a cross section at least as great as that of the outlet 50 for the middle gas. If it becomes desirable to change the function of the gasifier from a two-stage operation to that of a single-stage operation, the skirt 58 is lowered to a point where the plug 86 overlies the outlet 50 so that all or essentially all of the gas produced within the gasifier passes from the gasification zone 34 through the devolatization zone 32 and out the outlet 52 at the top end 20 of the gasifier. The position of the skirt 58 required for positioning the plug 86 over the outlet 50 would be at its lowest position in the gasifier so that the skirt 58 can be used to selectively adjust the middle gas off-take point during two-stage operation of the gasifier.

A further feature of the present invention is that the movable skirt 58 can be used to control the size of the annular volume in the gasifier. In instances where the composition of the gas may not be uniform across the gasifier cross-section, such as caused by channeling along the walls of the shell 14 and the cooling of the shell walls, the controlling of the size of the annular volume can be used to influence the composition of the middle off-take gas. By varying the size of the annular volume 23, the diameter of the middle gas take-off point, and the back pressure at the middle gas take-off point, the composition of the middle gas can be selectively regulated in an efficient manner. The vertical displacement of the skirt 58 over the outer surface of the wall 22 effectively provides a mechanism by which the cross-section of the annular volume can be increased or decreased to vary the back pressure within the annular volume 23 and thereby control the flow therethrough to further regulate the composition of the middle gas. The diameter of the middle gas take-off point can be adjusted by changing the thickness of the movable skirt 58 or the inside diameter of the gasifier shell 14 such as provided in the gasification zone 34 by the water-cooling jacket 46. With the jacket 46 present, the vertical movement of the skirt 58 closer to the jacket 46 effectively varies the diameter of the middle gas take-off point.

This vertical displacement of the skirt 58 also provides for naturally expanding the devolatization zone 32 so as to facilitate the use of swelling coals in the gasification operation. Without providing for such expansion in the devolatilization zone 32 the swelling coals would tend to plug the devolatilization zone 32.

It will be seen that the present invention provides a novel mechanism for adjusting the off-take point for the middle gas from a two-stage gasifier and thereby selectively controlling the composition of the middle gas. The present invention also provides for the facilitated use of swelling coals in two-stage gasifiers to increase the flexibility in the selection of coals utilized in the gasifier.

What is claimed is:

1. A fixed-bed coal gasification means comprising an enclosed gasifier having a volume therein defining a coal gasification zone and a coal devolatilization zone overlying the gasification zone, said gasifier comprising vertically oriented housing means having a first wall section substantially disposed about said volume and an second wall section connected to the first wall section and including a fixed elongated annular portion vertically extending into said first wall section and substantially encompassing said devolatilization zone, said annular portion being positioned in the first wall section at a location inwardly spaced therefrom for defining therebetween a vertically extending annular volume separated from the devolatilization zone by said annular portion and having an opening thereinto at the lowermost end thereof, inlet means in the second wall section for introducing coal into the devolatilization zone encompassed by the annular wall portion, first gas off-take means in registry with said second wall section at a location overlying the devolatilization zone for conveying from the gasifier gaseous products passing upwardly through the devolatilization zone, second gas off-take means in registry with the annular volume for conveying from a selected point of withdrawal in the gasifier as defined by the opening into the annular volume gasification products essentially comprising gaseous products generated in the gasification zone, and vertically movable means operatively associated with the annular portion and adapted to be vertically positionable within said volume for selectively positioning the opening into the annular volume and said point of withdrawal defined thereby to control at least the composition of the gaseous products discharged from the gasifier through said second gas off-take means.

2. A fixed-bed coal gasification means as claimed in claim 1, wherein said vertically movable means comprises an annular wall means coaxially disposed about said fixed annular wall portion and extendable to locations generally underlying said fixed annular wall portion, and wherein means are coupled to said annular wall means for vertically displacing the latter upwardly or downwardly within the volume to provide the selective positioning of said point of withdrawal.

3. A fixed-bed coal gasification means as claimed in claim 2 wherein the annular wall means is provided with a lower end surface disposed in a horizontal plane perpendicular to the vertical housing, wherein the annular wall means further defines said annular volume with said lower end surface defining the lower end of the annular volume and the vertical position of the opening into the annular volume, and wherein the vertical displacement of the annular wall means vertically positions the opening into the annular volume.

4. A fixed-bed coal gasification means as claimed in claim 3, wherein the vertical positioning of the opening into the annular volume primarily occurs in the vertical expanse of the gasification zone.

5. A fixed-bed coal gasification means as claimed in claim 3, wherein said annular wall means comprises a vertically extendable skirt having a substantially right circular cylinder configuration and disposed in close proximity to said fixed annular portion.

6. A fixed-bed coal gasification means as claimed in claim 3, wherein channel means are within said annular wall means and are adapted to receive coolant for cooling said annular wall means.

7. A fixed-bed coal gasification means as claimed in claim 3, wherein the annular wall means comprises a plurality of annular vertically spaced segments joined end to end.

8. A fixed-bed coal gasification means as claimed in claim 7, wherein channel means are within each of said annular segments for receiving coolant, wherein conduit means interconnect the channel means in each annular segment for conveying coolant through said passageway means.

9. A fixed-bed coal gasification means as claimed in claim 8, wherein plug means are disposed in said conduit means for controlling the flow of coolant therethrough.

10. A fixed-bed coal gasification means as claimed in claim 3, wherein means are supported by said annular wall means and are displaceable therewith for selectively blocking said second gas off-take means.

11. A fixed-bed coal gasification means as claimed in claim 3, wherein said means coupled to said annular wall means for vertically displacing the annular wall means comprises driven means attached to said annular wall means and extending to a location external to said housing means, and wherein selectively operatable drive means are disposed external to said housing means and are coupled to said driven means for driving the latter.

12. A fixed-bed coal gasification means as claimed in claim 3, wherein means disposed within said volume are adapted to selectively vary the diameter of the opening into the annular volume as the vertical displacement of the annular wall means vertically positions the opening into the annular volume.

* * * * *